United States Patent [19]

Juel et al.

[11] Patent Number: 4,832,506

[45] Date of Patent: May 23, 1989

[54] FLEXIBLE CONTAINER TO BE FILLED WITH BULK MATERIAL AND METHOD FOR ITS MANUFACTURE

[75] Inventors: Anders Juel; Bjarne Omdal, both of Porsgrunn, Norway

[73] Assignee: Norsk Hydro a.s., Oslo, Norway

[21] Appl. No.: 792,171

[22] Filed: Oct. 25, 1985

Related U.S. Application Data

[63] Continuation of Ser. No. 580,557, Feb. 14, 1984, abandoned.

[30] Foreign Application Priority Data

Mar. 2, 1983 [NO] Norway ..... 830718

[51] Int. Cl.[4] ..... B65D 33/06

[52] U.S. Cl. ..... 383/17; 383/8; 383/6; 383/7

[58] Field of Search ..... 383/6, 7, 8, 15, 16, 383/17, 20

[56] References Cited

U.S. PATENT DOCUMENTS

| | | | |
|---|---|---|---|
| D. 224,370 | 7/1972 | Berry | 383/17 |
| 1,400,499 | 12/1921 | Henderson | 383/15 |
| 1,564,101 | 12/1925 | Nakamura | 383/6 |
| 2,279,989 | 4/1942 | Hirschberg | 383/8 |
| 2,458,173 | 1/1949 | Kardon | 383/17 |
| 3,125,281 | 3/1964 | Woolen | 383/8 |
| 3,262,283 | 7/1966 | Taylor | 383/15 |
| 3,490,682 | 1/1970 | Schwarzkope | 383/15 |
| 3,774,837 | 11/1973 | Franson | 383/17 |
| 4,071,063 | 1/1978 | Russell | 383/7 |
| 4,136,723 | 1/1979 | Skaadel et al. . | |
| 4,149,339 | 4/1979 | Hall et al. | 383/8 |
| 4,240,480 | 12/1980 | Strobel | 383/15 |
| 4,244,408 | 1/1981 | Shoda | 383/8 |
| 4,269,247 | 5/1981 | Omdal | 383/8 |
| 4,273,274 | 6/1981 | Freistadt | 383/6 |
| 4,312,392 | 1/1982 | Sekiguchi | 383/7 |
| 4,393,910 | 7/1983 | Rasmussen | 383/8 |
| 4,420,021 | 12/1983 | Strand et al. . | |

FOREIGN PATENT DOCUMENTS

| | | | |
|---|---|---|---|
| 487026 | 10/1952 | Canada | 383/6 |
| 26287 | 4/1981 | European Pat. Off. | 383/7 |
| 2922514 | 12/1979 | Fed. Rep. of Germany | 383/7 |
| 1475019 | 6/1977 | United Kingdom | 383/8 |
| 1505583 | 3/1978 | United Kingdom . | |
| 1581438 | 12/1980 | United Kingdom | 383/7 |
| 2128585 | 10/1982 | United Kingdom | 383/6 |

*Primary Examiner*—David T. Fidei

*Attorney, Agent, or Firm*—Wenderoth, Lind & Ponack

[57] ABSTRACT

A flexible container is formed of a single piece of material and includes a bottom, a top and side walls, with two opposite openings in top portions of the side walls below the top. The material of the top is folded or gathered from the opposite openings toward the center of the top, thereby forming an integral lifting loop formed of integral extensions of the side walls. The lifting loop extends over the center of the container between the opposite openings. The thus folded or gathered material is joined at an uppermost lifting area of the lifting loop, thereby forming a permanent lifting handle.

10 Claims, 2 Drawing Sheets

FLEXIBLE CONTAINER TO BE FILLED WITH BULK MATERIAL AND METHOD FOR ITS MANUFACTURE

This applications is a continuation of now abandoned application Ser. No. 580,557, filed Feb. 14, 1984.

BACKGROUND OF THE INVENTION

The present invention relates to flexible containers to be filled with bulk material, and specifically to such containers having integral lifting loops and which may be manufactured from flat-woven or round-woven base material joined together for forming the lifting loops.

Containers of the above mentioned type have been used for some time and been found to be suitable for several purposes. Usually they have an inner bag or liner of impervious material. The container is usually first blown up by air before it is filled with free-flowing bulk material. Such a container is described in U.S. Pat. No. 4,136,723. This container has a double bottom and is preferably equipped with two integrated lifting loops having a total width substantially equal to half of the container circumference such that the lifting loops are formed of all of the longitudinal fibers of the container. The container can be filled by using an apparatus described in G.B. Pat. No. 1.505.583, and it will then stand on a floor or the like without any extra support. The lifting loops can be placed on a hook or the like before the container is blown up and filled with bulk material. The container can then be made ready for further transport, and this process might comprise closing the inner bag and joining the lifting loops by pressing them together and securing them in this position to obtain a suitable loop or handle which easily can be placed on a hook or some other lifting means. If a broad hook is employed to hang the lifting loops during the filling operation, the wide loops may be pressed together to a few cm and can be kept in this position by means of a tape. One will then obtain a well-defined loop which makes the container well suited for further transport, and this is described in EP-application No. 81108748,5 (publication No. 54145).

However, it has been found that the above mentioned process for making the container ready beforehand also has certain disadvantages. Also, when the container lifting loops are made ready after filling, there occur certain drawbacks. Thus the capacity of the filling apparatus will be reduced because of the time it takes for the operator to place the lifting loops onto a hook which will press them together. If this operation is carried out after the container is filled in order to improve the capacity of the apparatus, then the total filling operation will be more labour-consuming because an extra operator is needed for making the container loops ready. Further, the container's form itself implies that it is necessary to use filling apparatuses of a special type in order to obtain efficient filling and an effective process for making such containers ready. The fact that such special filling apparatuses are not available at all locations where filling of such containers might take place has accordingly hindered widespread use of the container.

The lifting loops may have a total width corresponding to half the container circumference, the result of which is that the process of joining together the loops to form one lifting loop or handle becomes somewhat labour-consuming. The wide loops also result in certain disadvantages when the container is placed on the filling apparatus or connected to it. Accordingly, there has been a need for making these operations easier and less labour-consuming.

One would like to continue having some form of lifting loops because of the good experience with integral lifting loops which, after filling of bulk material into the container, may be joined together by tape to form a transport lifting loop. During further transport of the container such lifting loops have been found to be suitable for receiving lifting hooks, forks and other means used for lifting and transporting the container.

When fork trucks are used, a special lifting device, on which the lifting loop is placed, is connected to the forks. It has further been found that the tape applied in certain cases can be damaged during the further lifting and transport of the container, especially if there are applied lifting forks having sharp edges, the load-carrying fibers of the material of the lifting loop can also be damaged.

In such cases there is therefore a need for a better protection of the fibers of the material of the lifting loop and a way of joining which can endure the strain when lifting forks are applied.

SUMMARY OF THE INVENTION

The object of the present invention is to provide a lifting loop having a permanent lifting handle which can endure the strain to which they will be exposed to during transport of the flexible container. Another object is to be able to apply all types of filling apparatuses and lifting devices, such that use of the container will not be limited by the need for special equipment. A further object is to provide a rational way of making flexible containers with an integral lifting loop equipped with a permanent lifting handle.

Manufacture of the lifting handle itself by joining the lifting loops at the filling station had been found to be rather labour-consuming and additionally required special hooks on the filling apparatus. To start with, it was desired to make a lifting handle which would be independent of special lifting hooks, and the inventors soon found that it would be easiest to make the lifting handle at the same place and time as the container itself was made.

If an empty container is equipped with a lifting loop having a permanent lifting handle, the transport of such empty containers will be more expensive than for the usual containers because of the larger volume to be transported. But it was found that the filling operation itself became so much easier when one used containers having permanent lifting handles that the advantages thereof would be far greater than the disadvantages of transporting such empty containers.

The problem then was how the permanent lifting handle could be formed most appropriately. It was found that the method would vary somewhat according to the type of base material from which the container was made. For containers having an integral lifting loop it can be generally said that one has two types of base material, i.e. flat-woven or round-woven textile material. The round-woven or tubular textile material can be joined together in different ways, for instance such that a lifting loop is formed either with a seam or without a seam. In the latter case, the container will have side seams. It was surprisingly found that it was possible to make the lifting handle principally in the same way for the different types of base materials. That part of the base material which is to form the lifting loops is, during formation of the flexible container, folded or gathered together in several layers, depending on the width of the container, at the center of the base material and is joined in this position at a specially defined area with glue, tape or at least one seam. The width of the lifting loop is thereby reduced to a suitable dimension for forming a lifting handle. It was further found that the total width of the lifting loop at least should be reduced to an extent such that the width of the lifting area is a maximum of 1/6 of the container circumference. There thus is formed a lifting loop with a lifting handle which is appropriate and advantageous for all operations of filling, handling, lifting, transport and discharge of the container. In certain cases, to avoid wear on the load-carrying fibers of the material of the lifting loop formed in this way, the lifting handle itself is equipped with an extra piece of material. This piece of material should cover at least the lower part of the lifting handle, i.e. that part which will lie against the lifting device, for instance a lifting fork, a hook or the like, when the flexible container is lifted and/or transported. This extra piece of material can also be in the form of a sleeve such that it surrounds the lifting handle. Such piece of material must be made from a strong material which can endure the strains to which it is exposed and which can be joined to the material of the lifting loop such that a permanent lifting point is obtained. This piece of material will preferably consist of woven material, for instance of the same type which is used in the container itself.

BRIEF DESCRIPTION OF THE DRAWINGS

The invention will now be further explained with reference to the drawings, wherein.

DETAILED DESCRIPTION OF THE INVENTION

Figure 1:
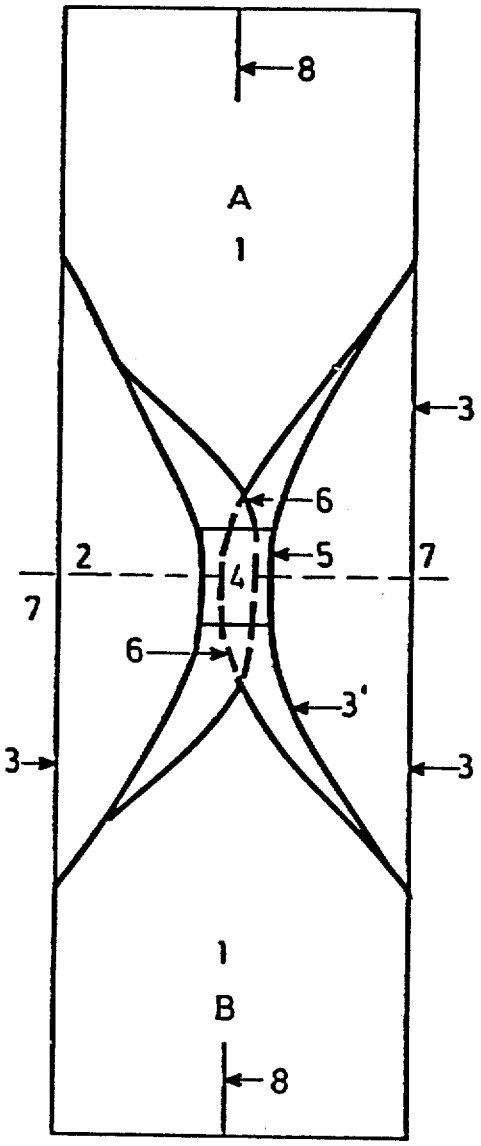
FIG. 1 shows a flat-woven base material for use in forming a flexible container according to the invention.

FIG. 1 shows a base material 1 consisting of two halves A and B, and with side edges 3 and cuts 8 which make it possible to form a container having a double bottom. The piece of material 1 is first folded or gathered toward center as shown in FIG. 1 such that those parts which later will form lifting loop 6 are collected in the middle of a folding line 2 in an area 4 which is less than approximately 1/6 of the container's circumference. In most cases it will be an advantage to have a lifting area 4 which is less than 1/10 of such circumference.

The side edges 3 thus be positioned as shown by the reference number 3'. The area 4 in the region of the lifting loop 6 is then joined by means of glue or preferably at least one seam. It is possible to fasten a piece of material 5 over the area 4, for instance by means of a seam. The piece of material 5 can be fastened around the area 4 such that it is in the form of a sleeve. The material 1 then is folded along the line 2 such that the halves A and B cover each other. Thereupon the container is sewn along the side edges 3, thus forming side walls, and at the bottom, thus resulting in a completely finished container with lifting loop 6 and a lifting handle 10 including the protecting piece of material 5. The piece of material 5 can be of woven material, for instance of the same type as that used for the container itself, or of some other suitable material which is strong enough to endure the stains to which it will be exposed during further handling of the container. The piece of material 5 might have a special color such that the lifting point is clearly marked, and it can for instance be color coded to indicate the type of container used or the material which shall be transported. FIG. 1 shows the application of an extra piece of material 5, but the permanent lifting handle 10 can, as previously mentioned, also be made without this, separate, piece of material, that is by just joining together the area 4 of the material.

Figure 2:
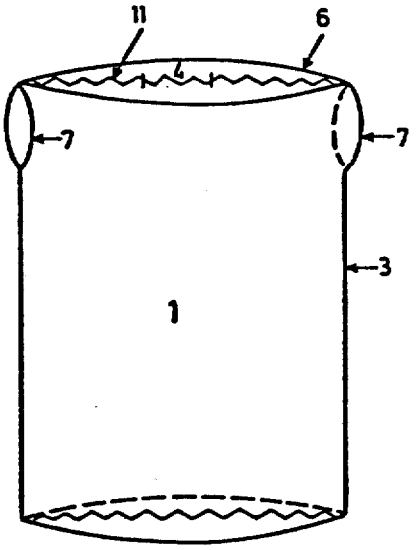
FIG. 2 shows a round-woven base material for forming a flexible container having a lifting loop formed by a seam.

FIG. 2 shows a tubular or round-woven base material 1 with the open ends thereof directed upwardly and downwardly This must first The open upper end is joined by seams 11 for forming at least one lifting loop 6. Thereupon cuts are made in the upper parts of the side walls of the tubular piece of material for forming openings 7 in which lifting such as a hook or fork can be placed, and which also can be used as filling openings for the bulk material which shall be transported or stored in the container. The lifting area 4 is then formed by folding together the material of loop 6 and joining by means of glue or at least one seam. A piece of material 5 can then be fastened to the area 4 in the same way as described in connection with FIG. 1, thus forming a permanent lifting handle 10. The container bottom can be formed in known manner, and the container is then ready for being filled.

Figure 3:
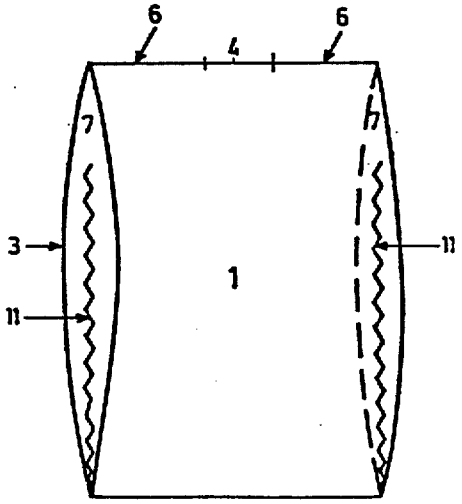
FIG. 3 shows a round-woven base material for forming a flexible container having a lifting loop without seams.

FIG. 3 also shows a tubular or round-woven base material 1, but with the open ends thereof directed laterally. The lifting area 4 can be formed by gathering or folding together the material of lifting loop 6 as described above. The container side edges or open ends are then joined by seams 11 which terminate somewhat below the lifting loop such that openings 7 are formed, thus forming side walls. Unless one desires to make the container with a special bottom, the container will now be ready for filling.

Figure 4:
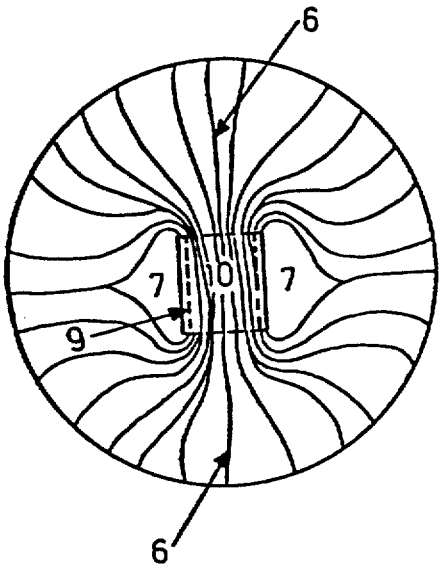
FIG. 4 shows a lifting loop with a lifting handle seen from above.

In FIG. 4 are shown a lifting loop 6 with lifting handle 10 as seen from above. The piece of material 5 which here is only fastened at the lower part of the lifting handle, is not visible on FIG. 4, but the seams 9 for fastening the piece of material 5 to the area 4 is shown. The openings 7 are here shown equally large, but if so desired the opening 7 which is to be used as a filling opening can be made somewhat larger than the other opening 7.

A container made according to the invention is ready for being connected directly to a filling apparatus. A filling pipe of such apparatus is put into one of the openings 7, and the container can be blown up by air and thereupon filled with free-flowing material. During the filling operation the lifting loop can be placed on a hook on the filling apparatus, but strictly speaking this is not necessary. It has in fact been found that the blown up container can stand freely and without substantial support sideways during the filling operation. As soon as the container is filled, it is necessary merely to close its inner bag, and then the container is ready for being transported.

By the present invention there is obtained a rational manufacture of a container with a lifting loop having a permanent lifting handle. Filling of such readymade containers can be carried out quickly and easily with fewer operators than usually is necessary when one has to form the lifting point at the filling station. The filling operation itself will accordingly be greatly simplified, as placement of the container on special lifting hooks or forming of lifting handles will not be necessary. The container will thereby be ready for further transport as soon as it is filled and the inner bag is closed. The capacity of the filling apparatus can be utilized maximally, and the total operation for filling and making the container ready for further transport will be less labour-consuming.

An essentitial advantage which is obtained by the present invention is that one is not dependent on complicated or special filling apparatuses or lifting devices. Thus, one can use lifting forks which easily can be inserted under the well-defined lifting handle, which is formed of sufficient strength that it can endure several handling operations of the filled container without damaging the lifting handle or the lifting loop by the handling devices. Even when especially rough lifting devices are used, the lifting handle according to the invention comprising the protecting piece of material 5 will protect the fibers in the lifting loop from wear.

We claim:

1. In a flexible container to be filled with bulk material and for the transportation thereof, said flexible container being of the type formed by a single piece of material and including a bottom, a top and side walls, with two opposite openings in top portions of said side walls below said top, the improvement comprising:

the material of said top above said openings being folded or gathered in directions from said opposite openings toward the center of said top, thereby forming a single integral lifting loop extending over the center of said container between said opposite openings; and means joining the thus folded or gathered material at an uppermost lifting area of said lifting loop above said openings, thereby forming a permanent lifting handle.

2. The improvement claimed in claim 1, further comprising an additional piece of material covering at least the lower portion of said lifting handle at said lifting area.

3. The improvement claimed in claim 2, wherein said additional piece of material comprises a sleeve surrounding said lifting handle.

4. The improvement clamed in claim 3, wherein said sleeve is formed of woven material.

5. The improvement claimed in claim 1, wherein said joining means comprises glue.

6. The improvement claimed in claim 1, wherein said joining means comprises at least one sewn seam.

7. The improvement claimed in claim 1, wherein said lifting area has a width no greater than 1/6 the circumference of said container.

8. The improvement claimed in claim 1, wherein said single piece of material comprises a flat, woven sheet of material folded along a center line at said top, with opposite ends joined to form said bottom, and with adjacent side edges joined to positions spaced from said center line to form said opposite openings.

9. The improvement claimed in claim 1, wherein said single piece of material comprises a tubular, woven member having a lower end closed to form said bottom, an upper open end closed to form said top, and opposite cuts formed in said tubular member to form said openings.

10. The improvement claimed in claim 1, wherein said single piece of material comprises a tubular, woven member having laterally directed open ends closed to positions spaced from said top to define said openings.

* * * * *

US004832506B1

REEXAMINATION CERTIFICATE (2771th)

United States Patent [19] [11] B1 4,832,506

Juel et al. [45] Certificate Issued Jan. 9, 1996

[54] FLEXIBLE CONTAINER TO BE FILLED WITH BULK MATERIAL AND METHOD FOR ITS MANUFACTURE

[75] Inventors: Anders Juel; Bjarne Omdal, both of Porsgrunn, Norway

[73] Assignee: Norsk Hydro A.S., Oslo, Norway

Reexamination Request:
No. 90/003,694, Jan. 18, 1995

Reexamination Certificate for:

| | |
|---|---|
| Patent No.: | **4,832,506** |
| Issued: | **May 23, 1989** |
| Appl. No.: | **792,171** |
| Filed: | **Oct. 25, 1985** |

Related U.S. Application Data

[63] Continuation of Ser. No. 580,557, Feb. 14, 1984, abandoned.

[30] Foreign Application Priority Data

Mar. 2, 1983 [NO] Norway ..... 830718

[51] Int. Cl.[6] ..... B65D 33/06

[52] U.S. Cl. ..... 383/17; 383/6; 383/7; 383/8

[58] Field of Search ..... 383/7, 8

[56] References Cited

U.S. PATENT DOCUMENTS

| | | | |
|---|---|---|---|
| 1,020,639 | 3/1912 | Curran . | |
| 2,656,093 | 10/1953 | Smith . | |
| 3,352,411 | 11/1967 | Schwarzkopf | 383/8 |
| 3,482,761 | 12/1969 | Suominen et al. | 383/8 |
| 4,191,229 | 3/1980 | Skaadel et al. . | |
| 4,269,247 | 5/1981 | Omdal | 383/8 |
| 4,368,765 | 1/1983 | Larkin et al. . | |
| 4,420,021 | 12/1983 | Strand et al. | 141/10 |

FOREIGN PATENT DOCUMENTS

| | | |
|---|---|---|
| 102164 | 4/1964 | Denmark . |
| 0047389 | 3/1982 | European Pat. Off. . |
| 0080926 | 6/1983 | European Pat. Off. . |
| 1516010 | 1/1968 | France . |
| 39-21319 | 7/1964 | Japan . |
| 43-9857 | 4/1968 | Japan . |
| 57-110090 | 7/1982 | Japan . |
| 1383254 | 2/1975 | United Kingdom . |
| 1525994 | 9/1978 | United Kingdom . |
| 2021519 | 12/1979 | United Kingdom . |
| 1581437 | 12/1980 | United Kingdom . |
| 2077221 | 12/1981 | United Kingdom . |

*Primary Examiner*—Stephen P. Garbe

[57] ABSTRACT

A flexible container is formed of a single piece of material and includes a bottom, a top and side walls, with two opposite openings in top portions of the side walls below the top. The material of the top is folded or gathered from the opposite openings toward the center of the top, thereby forming an integral lifting loop formed of integral extensions of the side walls. The lifting loop extends over the center of the container between the opposite openings. The thus folded or gathered material is joined at an uppermost lifting area of the lifting loop, thereby forming a permanent lifting handle.

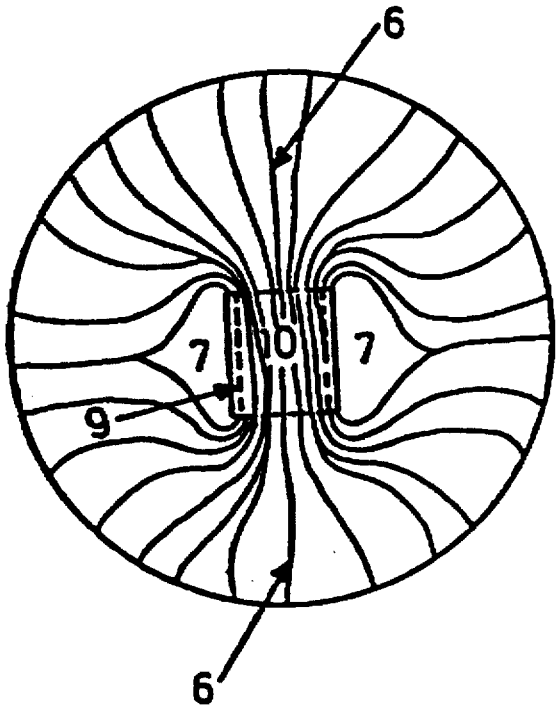

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–10, dependent on an amended claim, are determined to be patentable.

1. In [a] *an empty* flexible container to be filled *subsequent to the manufacture thereof* with bulk material and for the transportation thereof, said flexible container being of the type formed by a single piece of material and including a bottom, a top and side walls, with two opposite openings in top portions of said side walls below said top, the improvement comprising:

the material of said top above said openings being folded or gathered in directions from said opposite openings toward the center of said top, thereby forming a single integral lifting loop extending over the center of said container between said opposite openings; and means joining the thus folded or gathered material at an uppermost lifting area of said lifting loop above said openings, thereby forming a permanent lifting handle *enabling said flexible container to be lifted or supported during a subsequent filling operation.*

* * * * *